US012338689B2

(12) United States Patent
Eiman et al.

(10) Patent No.: US 12,338,689 B2
(45) Date of Patent: Jun. 24, 2025

(54) DOWNHOLE WET-MATE SYSTEMS AND METHODS USING WET-MATE DEPLOYMENT CARRIER

(71) Applicant: Halliburton Energy Services, Inc., Houston, TX (US)

(72) Inventors: Tyson H. Eiman, Frisco, TX (US); Jason P. Witte, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/473,364

(22) Filed: Sep. 25, 2023

(65) Prior Publication Data

US 2025/0101813 A1 Mar. 27, 2025

(51) Int. Cl.
*E21B 17/02* (2006.01)
*E21B 47/135* (2012.01)

(52) U.S. Cl.
CPC ..... *E21B 17/028* (2013.01); *E21B 47/135* (2020.05)

(58) Field of Classification Search
CPC ..... E21B 17/028; E21B 17/02; E21B 17/023; E21B 47/135
See application file for complete search history.

(56) References Cited

U.S. PATENT DOCUMENTS 4,204,739 A * 5/1980 Shoenleben ..... E21B 17/0285 439/805
7,165,892 B2 1/2007 Grigsby et al.
7,556,093 B2 7/2009 Grigsby et al.
7,900,698 B2 3/2011 Stoesz
2007/0267197 A1 11/2007 Pallini
2008/0311776 A1 12/2008 Cox
2014/0318809 A1* 10/2014 Joensen ..... E21B 17/04 166/242.6
2016/0123093 A1 5/2016 Richards
2022/0344091 A1* 10/2022 Stolboushkin ..... H01F 27/027
2023/0323738 A1* 10/2023 Cassidy ..... E21B 43/10 166/65.1
2024/0309707 A1* 9/2024 Steele ..... E21B 17/028

FOREIGN PATENT DOCUMENTS

KR 101616357 B1 4/2016
WO 2022109157 A1 5/2022

OTHER PUBLICATIONS

International Search Report and Written Opinion dated Jun. 17, 2024 for related PCT Application No. PCT/US2023/075077 filed Sep. 26, 2023.
TE Connectivity, SEACON G3 Optical Wet-Mate Connector, https://www.te.com/commerce/DocumentDelivery/DDEController?Action=srchrtrv&DocNm=2363000-1_seacon-G3-optical&DocType=DS&DocLang=EN.

* cited by examiner

*Primary Examiner* — George S Gray
(74) *Attorney, Agent, or Firm* — K&L Gates LLP

(57) ABSTRACT

A completion system for use in a wellbore includes an upper completion assembly including a stinger sub and a first portion wet-mate connector. The system also includes a lower completion assembly including a shift sleeve, a wet-mate deployment carrier, and a second portion wet-mate connector connectable with the first portion wet-mate connector. Axial movement of the shift sleeve in a first direction moves the wet-mate deployment carrier and the second portion wet-mate connector from a radially outward position to a radially inward position such that the second portion wet-mate connector is positioned to connect with the first portion wet-mate connector.

17 Claims, 5 Drawing Sheets

DOWNHOLE WET-MATE SYSTEMS AND METHODS USING WET-MATE DEPLOYMENT CARRIER

BACKGROUND

The utilization of advanced communication lines in various industries has gained significant traction in recent years. One notable example is the utilization of fiber optic technology, which has proven to be highly beneficial. This technology facilitates the transmission of valuable data in different industries, such as the oil and gas industry, allowing for improved monitoring and optimization of various parameters. For instance, in the oil and gas industry, fiber optic lines provide insights into well conditions, including pressure, temperature, flow rates, etc., enabling operators to enhance production efficiency. Despite these advances, challenges still remain in connecting communication lines in wells.

One challenge is to maximize the internal diameter of the lower assembly for fluid flow and tool passage while at the same time being able to position a wet-mate connector in the internal bore when needed. While the initial challenge may have involved fiber optic lines, the focus is on maximizing the internal diameter (ID) to enhance overall performance in different applications, not just limited to fiber optics.

BRIEF DESCRIPTION OF THE DRAWINGS

Embodiments of the DOWNHOLE WET-MATE SYSTEMS AND METHODS USING WET-MATE DEPLOYMENT CARRIER are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
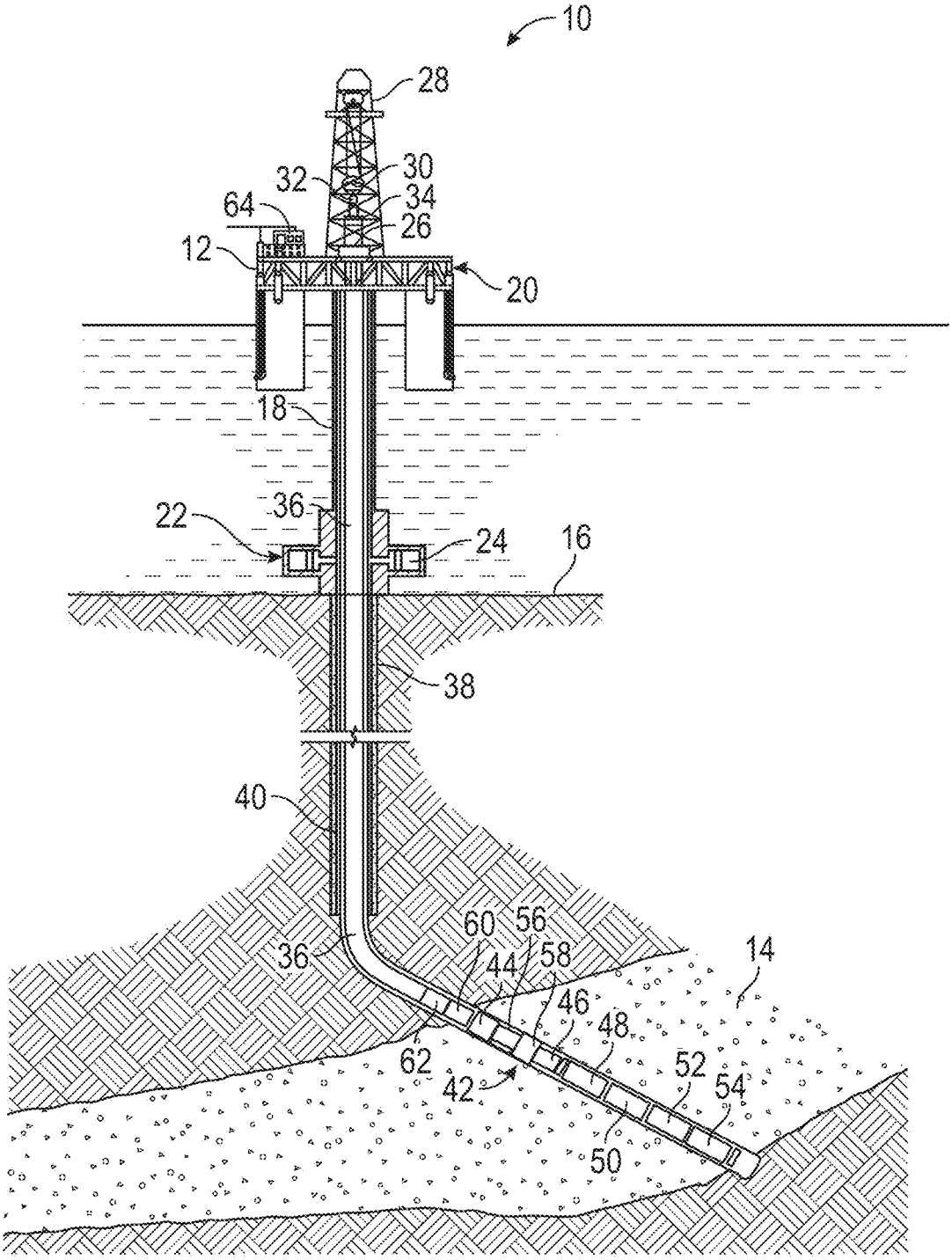
FIG. 1 is a schematic illustration of an offshore oil and gas platform operating an apparatus for installing a downhole completion system according to one or more embodiments.

The present disclosure helps address the issues discussed above. The present disclosure describes a wellbore completion system that uses a first portion wet-mate connector and a complementary second portion wet-mate connector. The first portion wet-mate connector is run into a wellbore on a conveyance such as a production string as part of an upper completion assembly. The upper completion assembly connects with a complimentary lower completion assembly that includes the complementary second portion wet-mate connector to establish the wet-mate connection.

An aspect of the present disclosure solves the challenge discussed in the BACKGROUND section by utilizing a first portion wet-mate connector on an upper completion assembly and a second portion wet-mate connector mounted on a lower completion assembly. The second portion wet-mate connector on the lower completion assembly can be placed in a retracted position internal to the lower completion assembly, thus maximizing the internal diameter of the inner bore of the lower completion assembly. Following gravel pack operations and after the retrieval of the gravel pack service tool, the second portion wet-mate connector is deployed for connection by shifting a shift sleeve which extends the wet-mate connector radially inward. On the upper completion assembly, the first portion wet-mate connector is mounted on a stinger sub and connects to the deployed second portion wet-mate connector. Keeping the second portion wet-mate connector in a retracted position and then deploying after the gravel pack operations allows for a larger internal diameter (IDs) above and below the wet-mate connection during the gravel pack operations for tool passage and increased fluid flow.

To illustrate the functionality of the wet-mate connector system, consider the following example: during gravel pack operations, the lower completion assembly is in place with the second portion wet-mate connector retracted internally into the assembly. With the second portion wet-mate connector in the retracted position, the second portion wet-mate connector is moved radially outward and the internal bore of the lower completion assembly is maximized. The gravel pack service tool is being utilized to perform the necessary tasks and can move past the second portion wet-mate connector. Once the gravel pack operations are completed, a shift sleeve is moved to shift the second portion wet-mate connector radially inward, deploying the second portion wet-mate connector into a connection position.

Simultaneously, on the upper completion assembly, the first portion wet-mate connector, mounted on a stinger sub, awaits the connection. As the second portion wet-mate connector is deployed, it connects with the first portion wet-mate connector, establishing a link between the upper and lower completion assemblies. This wet-mate connection mechanism helps to provide a secure coupling between the two assemblies, crucial for maintaining the integrity of the wellbore.

The strategic approach of running the second portion wet-mate connector in a retracted position before deployment allows for larger internal diameters (IDs) both above and below the wet-mate connection during gravel pack operations. This design consideration is vital to facilitate the flow of fluids and particles during the gravel pack process, enhancing the overall efficiency of the operation. Furthermore, after the wet-mate connection is established, the increased IDs for the production flow area beneath the connector contribute to optimized production rates, maximizing the wellbore's productivity.

Turning now the figures, FIG. 1 is a schematic illustration of an offshore oil and gas drilling and completion system 10 for drilling an offshore wellbore 38. Although an offshore wellbore 38 is illustrated, it should be appreciated that the present disclosure is also applicable to a land based wellbore. A semi-submersible platform 12 is located over a submerged subterranean oil and gas formation 14 located below a sea floor 16. A subsea conduit 18 extends from a deck 20 of the platform 12 to a wellhead installation 22, which includes at least one blowout preventer 24. The platform 12 has a hoisting apparatus 26, a derrick 28, a travel block 30, a hook 32, and a swivel 34 for raising and lowering pipe strings, such as a substantially tubular, axially extending production tubing 36. The production tubing 36 is part of an upper completion assembly shown in FIG. 1 as not yet being connected with a lower completion assembly. Disposed in the wellbore 38 at the lower end of the production tubing string 36 are a variety of tools included as part of the upper completion assembly such as a mandrel 62 and a stinger sub 60 that includes a first portion wet-mate connector. Additionally, a control system 64 may be provided on the semi-submersible platform 12. For example, the control system 64 may be a control system comprising a microcontroller, memory, digital or analog inputs in a structure, such as an office, on the semi-submersible platform 12. The control system 64 may be used to control and operate one or more components of the offshore oil and gas drilling and completion system 10.

The wellbore 38 extends through the various earth strata including the formation 14. An upper portion of the wellbore 38 includes a casing 40 that is cemented within the wellbore 38. Disposed in an open hole portion of the wellbore 38 is a lower completion assembly 42. The lower completion assembly 42 can also include various tools such as a packer 44, a seal bore assembly 46, and sand control screen assemblies 48, 50, 52, 54. The lower completion assembly 42 can also be considered an example of a sand control system. The lower completion assembly 42 also includes an orientation and alignment subassembly and lower completion wet-mate sub 56 that houses a downhole wet-mate connector (discussed further below). Extending downhole from the lower completion wet-mate sub 56 is a conduit 58 that passes through the lower completion assembly and is operably associated with the sand control screen assemblies 48, 50, 52, 54.

FIGS. 2-5 illustrate a completion system 100 in accordance with one or more embodiments. As shown, the completion system 100 includes an upper completion assembly 102 and a lower completion assembly 104 (shown connected in FIG. 2). The upper completion assembly 102 is connected to a production tubing string as shown in FIG. 1 and includes an upper completion wet-mate sub 106. The upper completion assembly 102 may also include various types of valves, chokes, packers, and other devices used to control the flow of fluids and gas from the wellbore.

The upper completion wet-mate sub 106 includes a stinger sub 110 and a mandrel 108. The stinger sub 110 includes a first portion wet-mate connector 118, to which a first portion cable (or fiber optic cable/energy transfer line) 116 is connected. The first portion cable 116 extends in a fiber channel 179 in the stinger sub 110 for protection during deployment downhole. Also included in the stinger sub 110 and connected to the first portion wet-mate connector 118 is a spring 176. The spring 176 allows for movement of the connector 118 and compensates for potential misalignments during the mating process of the first portion wet-mate connector 118, ensuring a secure connection even if the mating surfaces are not perfectly aligned. The spring 176 also helps absorb shocks and vibrations experienced during installation and wellbore operations, preventing damage to the connectors and maintaining a stable connection over time.

The stinger sub 110 is a component of the upper completion assembly 102 that is used to direct the flow of hydrocarbons from the wellbore into the production tubing. The stinger sub 110 is attached through the mandrel 108 (see e.g., FIG. 4) to the bottom of the production tubing that extends down into the wellbore to establish a fluid connection between the lower completion assembly 104 and the production tubing of the upper completion assembly 102. The stinger sub 110 may be perforated along its length to allow fluid to flow into the stinger sub 110 and then to the production tubing. The stinger sub 110 may be helpful in wells that produce from multiple zones or in situations where it is desirable to isolate certain sections of the wellbore to optimize production.

The first portion cable 116, incorporated within the upper completion wet-mate sub 106, serves as a pathway to transmit data and energy signals. The first portion cable 116 is designed to facilitate the transmission of fiber optic signals or other energy transfer lines. It enables real-time data transfer between different components in the well completion system, allowing for efficient management of well operations and providing insights into wellbore conditions, production rates, pressure, temperature, and other important parameters. Additionally, the first portion cable 116 supports remote monitoring and control of the well, enabling operators to make necessary adjustments to optimize production.

The lower completion assembly 104 includes a lower completion wet-mate sub 120 that includes a shift sleeve 170, a wet-mate deployment carrier 173, a second-portion wet-mate connector 128, a second portion cable 130 (or fiber optic cable/energy transfer line), and a housing/main body 122 connected to a bottom sub 124. The housing/main body 122 and bottom sub 124 provide structural support to the lower completion assembly 104 and house various other elements. The lower completion assembly 104 may also include components such as sand control screens, fluid flow control devices, wellbore isolation devices, and the like. The second portion cable 130 may be used to convey energy or communication signals and may also be used as a sensor to detect one or more conditions relating to at least one parameter related to the wellbore environment, for example, the production of formation fluids.

Figure 2:
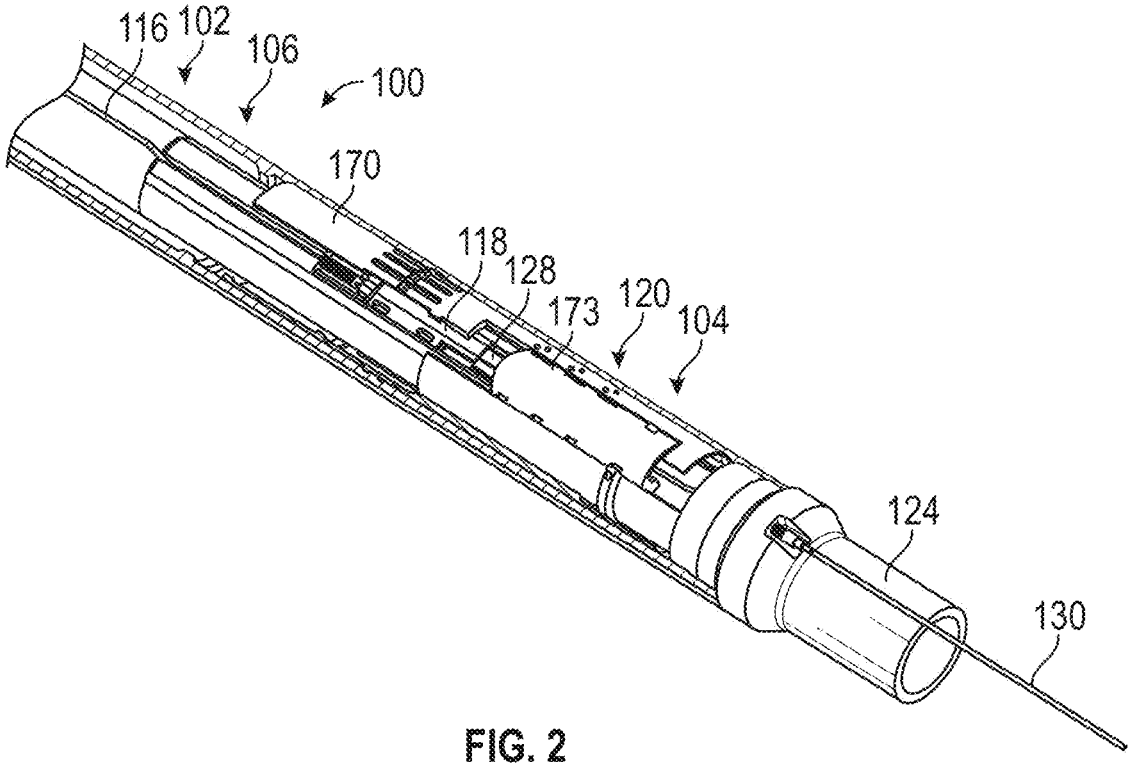
FIG. 2 is an isometric illustration of a completion system in accordance with one or more embodiments.
Figure 3:
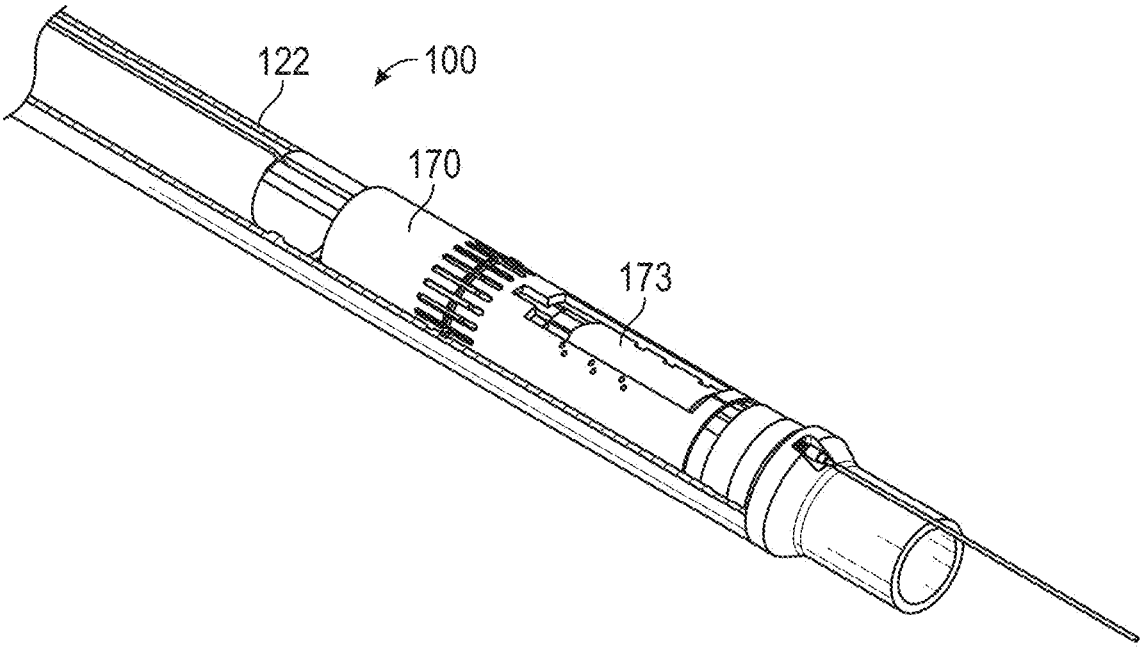
FIG. 3 is an isometric illustration of a deployed completion system in accordance with one or more embodiments.
Figure 4:
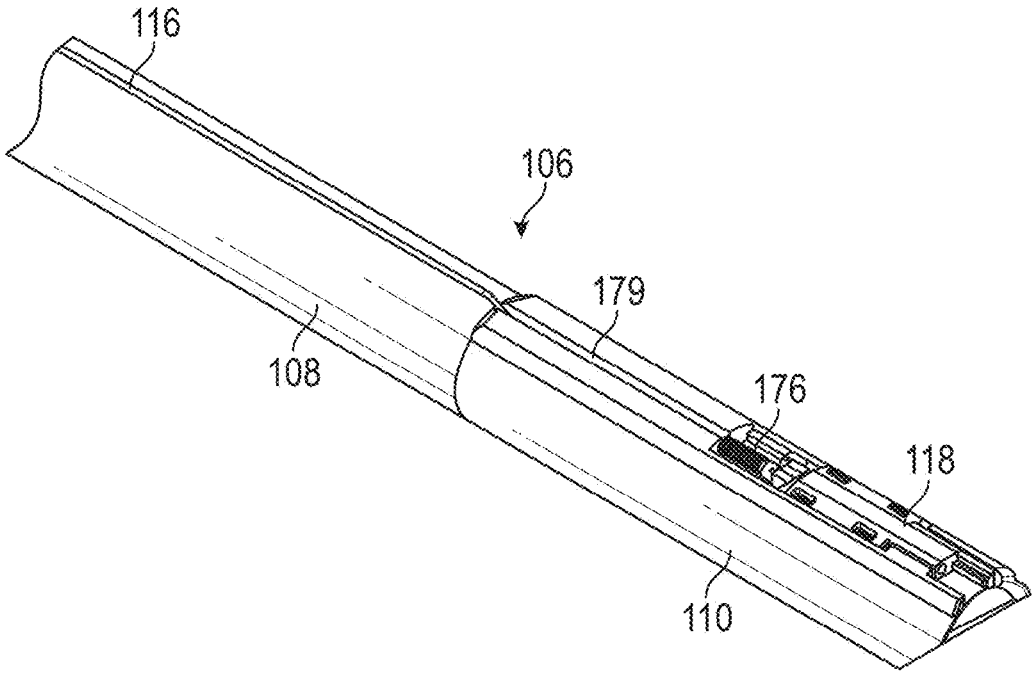
FIG. 4 is an isometric illustration of an upper completion wet-mate sub of the completion system of FIG. 2 in accordance with one or more embodiments.

As shown in FIG. 2, the upper completion assembly 102 and the lower completion assembly 104 engage each other to engage the first portion wet-mate connector 118 with the second portion wet-mate connector 128 to establish a wet-mate connection. As described herein, the terms "first portion" and "second portion" may be used to differentiate between the two components of the wet-mate connection. Also described herein, the terms "first wet-mate" and "second wet-mate" may be used to differentiate between the terms the "plug" and the "socket" or the "male" and the "female" for the two components. In addition, the general term "wet-mate connector" or "connector" may be used. In some embodiments, a system can use a socket wet-mate connector, for example positioned on an upper completion assembly, and a mating plug wet-mate connector, for example positioned on a lower completion assembly.

Although the completion system 100 is described as including fiber optic wet-mate connectors and fiber optic lines, the completion system 100 may also or in the alternative include electric, hydraulic, electro-hydraulic, or electro-fiber wet-mate connectors, any other suitable wet-mate connectors, or any combination thereof and corresponding similar lines. There may also be more than one wet-mate connector such as two or more on parallel lines. There may be wet-mate connectors with one or more types of energy used. For example, there may be two fiber optic wet-mate connectors in parallel, there may be three fiber optic lines and one electrical wet-mate connector. There may be one or combinations of all the above in various arrangements and combinations. In addition to fiber optic lines, energy transfer lines may be used. As described herein, an "energy transfer line" can be used to transfer one or more energy signals. The energy transfer line can be used to convey energy from or to another locale, or device, which may be located at the surface of the well or somewhere else. The energy transfer line may transfer one or more forms of energy. For example the following forms (or types) of energy or energy transfer may be used: light, electric, fluid (hydraulic, water, fuel, etc.), magnetic, electromagnetic (all forms), thermal (heat), acoustic (sound), motion (mechanical), inductive, etc. The energy transfer line may be used to transfer power, signals, data, information, conditional information, sensed information or data, computed information or data, logical information, filtered or conditioned information, data, or power, unfiltered information, data, or power, etc. The transfer of energy may be continuous (i.e., DC current), alternating (i.e., AC current), pulsed (i.e., digital 1s and 0s, pressure pulses, flow pulses, current or voltage changes, etc.). The transfer of energy may be unidirectional (i.e., from surface down) or bidirectional (i.e., from surface down and from subterranean to surface, etc.). Furthermore, there may be more than one energy transfer line such as two or more approximately parallel lines. There may be an energy transfer line with one or more types of energy used. For example, there may be two fiber optic fibers run in parallel, there may be three fiber optic lines and one electrical line, there may be two twisted electrical lines, there may be two electromagnetic field shielded electric lines, etc. There may be one or combinations of all the above in various arrangements and combinations.

Figure 5:
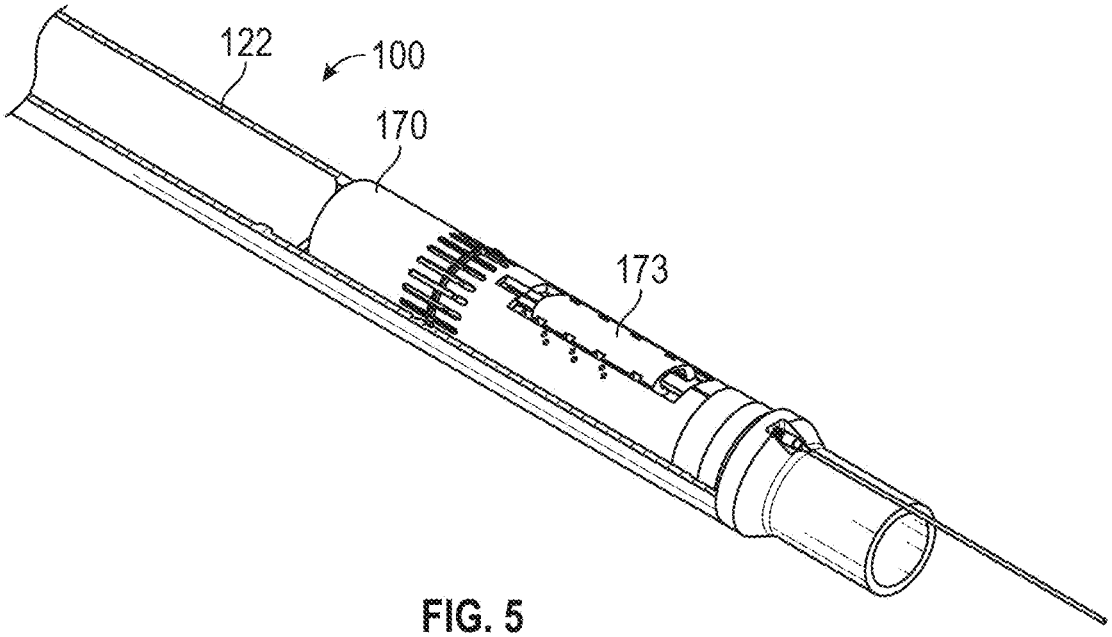
FIG. 5 is an isometric illustration of lower completion wet-mate sub of the completion system of FIG. 3 in accordance with one or more embodiments.
Figure 6:
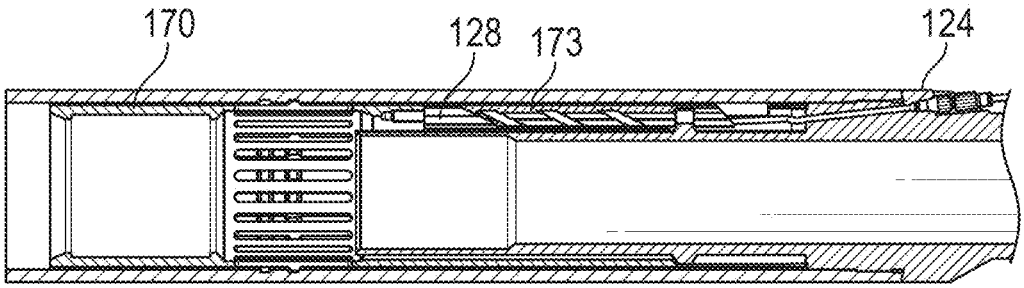
FIG. 6 is a side view illustration of the wet-mate connector retracted in accordance with one or more embodiments.
Figure 7:
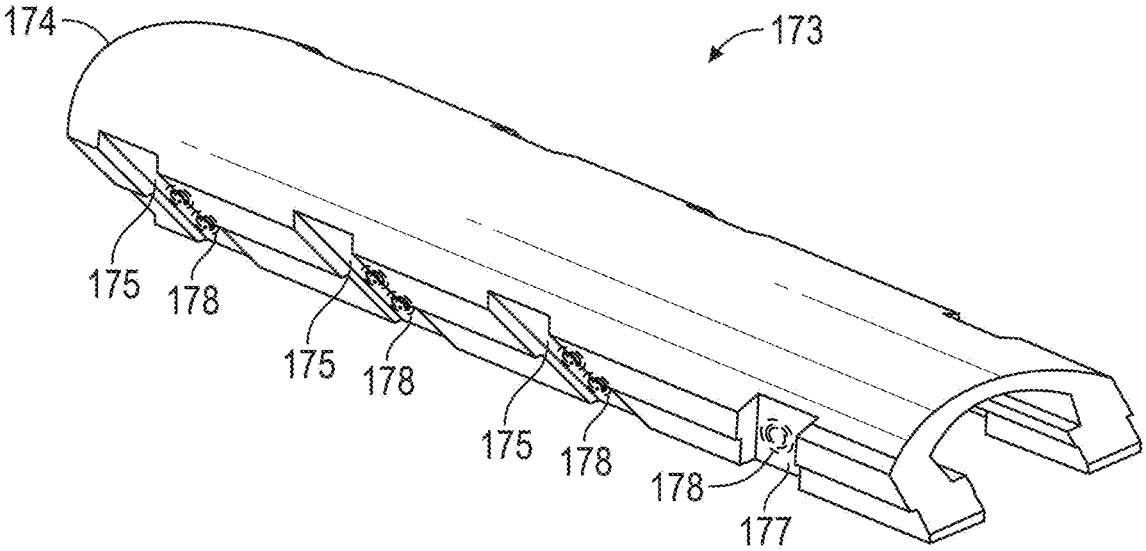
FIG. 7 is an isometric illustration of the wet-mate deployment carrier of FIG. 2 in accordance with one or more embodiments.

FIGS. 6 and 7 provides a closer view of the relationship between the shift sleeve 170 and the wet-mate deployment carrier 173. As shown, the lower completion wet-mate sub 120 includes the shift sleeve 170 and the wet-mate deployment carrier 173. As shown in FIG. 7, the wet-mate deployment carrier 173 includes a body 174 with an outwardly facing surface and two sides that fit within an opening of the shift sleeve 170 (as shown in FIG. 5). Each side includes multiple shift grooves 175 and one or more sub grooves 177. The shift grooves 175 are angled with respect to the longitudinal axis of the shift sleeve 170. The sub groove 177 is perpendicular with respect to the longitudinal axis of the shift sleeve 170. As best shown in FIGS. 2 and 6, the shift sleeve 170 and the bottom sub 124 include extensions (see 178 in FIG. 7) such as pegs or rollers that are moveably constrained to travel within the shift grooves 175 and the sub groove 177 respectively. In this manner, the shift grooves 175 and the sub groove 177 control the movement of the wet-mate deployment carrier 173 relative to the shift sleeve 170 and the bottom sub 124 as explained below.

An advantage of initially keeping the second portion wet-mate connector 128 retracted in a radially outward position lies in the increased internal diameter (ID) across the second portion wet-mate connector 128 during various operations, such as gravel pack operations. Furthermore, this approach provides an increased internal diameter for fluid flow through the lower completion assembly 104 when the second portion wet-mate connector 128 is retracted.

Figure 8:
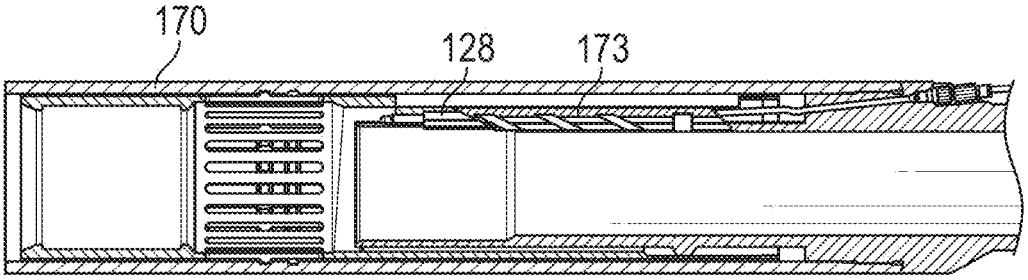
FIG. 8 is a side view illustration of the wet-mate connector deployed in accordance with one or more embodiments.
Figure 9:
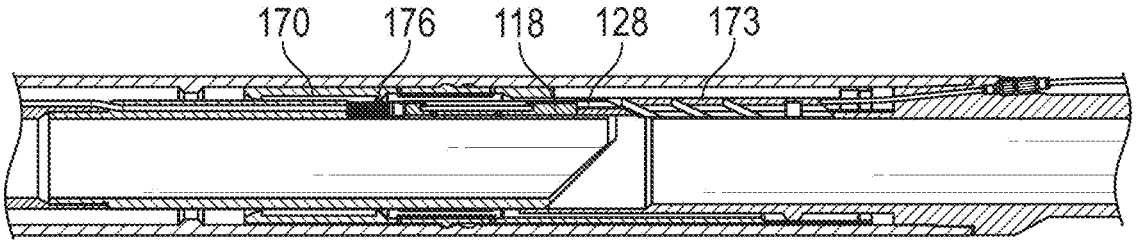
FIG. 9 is a side view illustration of the wet-mate connector connected in accordance with one or more embodiments.

FIGS. 8 and 9 illustrate the deployment process of the upper completion assembly 102 within the wellbore, as well as establishing a connection with the lower completion assembly 104, forming a wet-mate connection. The shift sleeve 170 is the mechanism that enables the engagement of the first and second portion wet-mate connectors 118, 128. To do so, the shift sleeve 170 moves the wet-mate deployment carrier 173 and thus the second-portion wet-mate connector 128 between a retracted, radially outward position and a radially inward position for connection. As shown in FIG. 8, the shift sleeve 170 has been moved axially in an uphole direction from a retracted position to an extended position.

An actuator (not shown) located in the completion assembly operates to move the shift sleeve 170 forwards and backwards axially. The actuator may be a mechanical or electronic device designed to convert energy into motion, thereby carrying out a specific function. In this context, the actuator tasked with moving the shift sleeve might be a hydraulic actuator, which utilizes fluid pressure to generate motion. Alternatively, an electric actuator may be employed, relying on electrical energy to achieve the necessary shift sleeve movements. Alternatively, a mechanical actuator connected to a service tool string extending to the surface may be employed to achieve the necessary shift sleeve movements when pulled or pushed through the completion assembly. In the case of a hydraulic actuator, the actuator unit may be integrated into the completion assembly, featuring a hydraulic system with fluid lines connected to the shift sleeve mechanism. When activated, the hydraulic actuator builds up pressure in the fluid lines, exerting force on the shift sleeve, causing it to move axially. By controlling the fluid flow and pressure, the actuator may position the shift sleeve 170 as needed, ensuring the accurate deployment of the upper completion assembly. If an electric actuator is employed, the electric actuator may include a compact electric motor and a gearbox arrangement. The actuator's motor receives electrical signals from a control system such as the control system 64 shown in FIG. 1, which regulates the motor's rotational output. The gearbox then converts this rotational motion into linear motion, allowing the actuator to drive the shift sleeve in the desired axial direction.

The control system may be located downhole in the lower completion assembly 104 or may be located at the surface and in communication with the actuator downhole. The control system may be an electronic control module or controller (not shown) comprising a microcontroller, memory, digital or analog inputs for receiving information from sensors, outputs for communicating to the actuators, and software for processing the inputs and communicating through the outputs to the actuators. In one method, the electronic control module receives pressure pulses from the surface to activate the electric actuator. Pressure pulses can be varied to extend the actuator with one combination of pulses and a separate set of pulses to retract the actuator. Alternatively, the electronic control module can be activated with a mechanical switch, located inside the lower completion wet-mate sub 120, which is depressed by the profile on the wet-mate sub 106 when the wet-mate sub 106 enters the lower completion wet-mate sub 120. When the switch is mechanically activated, the electric actuator is activated to extend the second portion wet-mate connector 128. When the switch is subsequently mechanically deactivated by the withdrawal of the wet-mate sub 106 from the lower completion wet-mate sub 120, the actuator is activated to retract the second portion wet-mate connector 128. Alternatively, a magnet can be placed in the upper completion wet-mate sub 106 and when the upper completion wet-mate sub 106 passes a sensor located in the lower completion assembly 104 the electronic control module activates the electric actuator to extend the second portion wet-mate connector 128 for connection to the first portion wet-mate connector 118. Subsequently following disconnection of the first portion wet-mate connector 118 and after passing the magnet across the sensor in the opposite direction, the electronic control module activates the electric actuator to retract the second portion wet-mate connector 128. The control system can be powered by a suitable battery or other energy storage device. Such a battery or other energy storage device may also be used to power the actuator should the actuator be an electrical actuator.

To establish the wet-mate connection, the actuator moves the shift sleeve 170 axially. Movement of the shift sleeve 170 axially moves the wet-mate deployment carrier 173 and also the second portion wet-mate connector 128 between a radially outward position and a radially inward position. This radially inward movement is caused by the angle of the shift grooves 175 and the angle of the sub groove 177. As the shift sleeve 170 moves axially, movement of the wet-mate deployment carrier 173 is restricted in the axial direction by the angle of the sub groove 177 being perpendicular to the axial direction. The peg or roller that travels in the sub groove 177 is fixed to the bottom sub 124 and since the bottom sub 124 does not move axially with the shift sleeve 170 and the peg restricts movement of the carrier 173, the carrier is restricted from moving axially as well. However, the sub groove 177 being oriented in the perpendicular or radial direction, allows the carrier 173 to move radially. Although the sub groove 177 allows radial movement, the actual radial movement is caused by the travel of the pegs in the shift grooves 175. Since the shift grooves 175 are angled, travel of the shift sleeve 170, and thus the extensions or pegs, axially causes the pegs to travel in the shift grooves 175, which since the carrier 173 cannot move axially causes the carrier 173 to move radially. The movement of the shift sleeve 170 axially and the carrier 173 from the radially outward position to the radially inward position is shown in the differences between FIGS. 6 and 8. The movement of the wet-mate deployment carrier 173 also moves the second portion wet-mate connector 128, enabling the second portion wet-mate connector 128 to transition between a radially outward position and a radially inward position.

As depicted in FIG. 9, once the wet-mate deployment carrier 173 and thus the second portion wet-mate connector 128 reach the radially inward position, the second portion wet-mate connector 128 is aligned to connect with the first portion wet-mate connector 118. To do so, the upper completion assembly 102 moves into position by having the stinger sub 110 traveling into the housing/main/body 122, which is connected to the bottom sub 124. As discussed above, the stinger sub 110 houses the first portion wet-mate connector 118. As the stinger sub 110 travels into the housing/main body 122, the stinger sub 110 also travels into the shift sleeve 170. The stinger sub 110 is configured to position the first portion wet-mate connector 118 at the same radially inward position as the shift sleeve 170 positions the second portion wet-mate connector 128. The stinger sub 110 continues to travel into the housing 122 until the stinger sub 110 "lands" into position to establish a fluid connection for formation fluids between the lower completion assembly 104 and the upper completion assembly 102. Continued movement of the stinger sub 110 into the shift sleeve 170 also causes the first portion wet-mate connector 118 to connect and establish a wet-mate connection with the second portion wet-mate connector 128 as shown in FIG. 9.

When the need arises to retrieve the upper completion assembly 102, the upper completion assembly 102 is disengaged from the lower completion assembly 104. With the stinger sub 110 removed from the shift sleeve 170 and the first portion wet-mate connector 118 disengaged, the wet-mate deployment carrier 173 and the second portion wet-mate connector 128 may be retracted back to the radially outward position. To do so, the actuator moves the shift sleeve 170 axially in the reverse direction. Moving the shift sleeve 170 back moves the wet-mate deployment carrier 173 and thus the second portion wet-mate connector 128 radially outward in reverse of the process described above to move the wet-mate deployment carrier 173 radially inward. As described above, moving the second portion wet-mate connector 128 radially outward increases the internal diameter (ID) across the second portion wet-mate connector 128. This allows the passage of tools internally of a greater diameter than would be passable with the second portion wet-mate connector positioned radially inward. Furthermore, this approach provides an increased internal diameter for fluid flow through the lower completion assembly 104 when the second portion wet-mate connector 128 is retracted.

Examples of the above embodiments include:

Example 1 is a completion system for use in a wellbore that includes an upper completion assembly including a stinger sub and a first portion wet-mate connector. The system also includes a lower completion assembly that includes a shift sleeve, a wet-mate deployment carrier, and a second portion wet-mate connector connectable with the first portion wet-mate connector. Axial movement of the shift sleeve in a first direction moves the wet-mate deployment carrier and the second portion wet-mate connector from a radially outward position to a radially inward position such that the second portion wet-mate connector is positioned to connect with the first portion wet-mate connector.

In Example 2, the embodiments of any preceding paragraph or combination thereof further include wherein axial movement of the shift sleeve in a second direction opposite the first direction retracts the second portion wet-mate connector into the shift sleeve as the second portion wet-mate connector moves from the radially inward position to the radially outward position.

In Example 3, the embodiments of any preceding paragraph or combination thereof further include wherein the lower completion assembly further comprises an actuator operable to move the shift sleeve axially.

In Example 4, the embodiments of any preceding paragraph or combination thereof further include wherein the wet-mate deployment carrier comprises shift grooves angled with respect to the axial movement direction of shift sleeve, the shift sleeve comprises extensions movably constrained to travel within the shift grooves, and the movement of the shift sleeve axially moves the wet-mate deployment carrier radially due to the travel of the extensions within the shift grooves.

In Example 5, the embodiments of any preceding paragraph or combination thereof further include an electronic control module operatively connected to the actuator and configured to selectively operate the actuator to control the movement of the shift sleeve and thus the wet-mate deployment carrier.

In Example 6, the embodiments of any preceding paragraph or combination thereof further include wherein the first and second portion wet-mate connectors comprise fiber optic, electric, hydraulic, electro-hydraulic, or electro-fiber wet-mate connectors, or any combination thereof.

In Example 7, the embodiments of any preceding paragraph or combination thereof further include a second portion fiber optic cable connected with the second portion wet-mate connector, the second portion fiber optic cable configured to measure at least one parameter related to the wellbore environment.

In Example 8, the embodiments of any preceding paragraph or combination thereof further include a first portion fiber optic cable configured to transmit at least one of data or energy signals.

In Example 9, the embodiments of any preceding paragraph or combination thereof further include wherein the lower completion assembly further comprises a sand control system, and wherein the sand control system comprises at least one of a gravel pack, a frack pack, or a standalone screen.

Example 10 is a method for completing a wellbore including installing a lower completion assembly downhole in the wellbore, the lower completion assembly comprising a shift sleeve and a second portion wet-mate connector movable on a wet-mate deployment carrier. The method also includes conveying an upper completion assembly downhole into the wellbore, the upper completion assembly comprising a stinger sub and a first portion wet-mate connector. The method also includes moving the shift sleeve axially in a first direction, thereby also moving the wet-mate deployment carrier and the second portion wet-mate connector from a radially outward position to a radially inward position. The method also includes connecting the first portion wet-mate connector with the second portion wet-mate connector in the radially inward position.

In Example 11, the embodiments of any preceding paragraph or combination thereof further include moving the shift sleeve axially in a second direction opposite the first direction, thereby retracting the second portion wet-mate connector into the shift sleeve in the radially outward position.

In Example 12, the embodiments of any preceding paragraph or combination thereof further include moving the shift sleeve axially with an actuator.

In Example 13, the embodiments of any preceding paragraph or combination thereof further include operating the actuator mechanically.

In Example 14, the embodiments of any preceding paragraph or combination thereof further include transmitting at least one of data or energy signals using a first portion fiber optic cable connected with the first portion wet-mate connector.

In Example 15, the embodiments of any preceding paragraph or combination thereof further include measuring at least one parameter related to the wellbore environment using a second portion fiber optic cable connected with the second portion wet-mate connector.

Example 16 is a completion system for use in a wellbore, including a lower completion assembly that includes a shift sleeve, a wet-mate deployment carrier, and a second portion wet-mate connector. Axial movement of the shift sleeve in a first direction moves the wet-mate deployment carrier and the second portion wet-mate connector from a radially outward position to a radially inward position such that the second portion wet-mate connector is positioned for wet-mate connection.

In Example 17, the embodiments of any preceding paragraph or combination thereof further include wherein axial movement of the shift sleeve in a second direction opposite the first direction retracts the second portion wet-mate connector into the shift sleeve as the second portion wet-mate connector moves from the radially inward position to the radially outward position.

In Example 18, the embodiments of any preceding paragraph or combination thereof further include wherein the lower completion assembly further comprises an actuator operable to move the shift sleeve axially.

In Example 19, the embodiments of any preceding paragraph or combination thereof further include wherein the second portion wet-mate connector comprises a fiber optic, an electric, a hydraulic, an electro-hydraulic, or an electro-fiber wet-mate connector, or any combination thereof.

In Example 20, the embodiments of any preceding paragraph or combination thereof further include a second portion fiber optic cable connected with the second portion wet-mate connector, the second portion fiber optic cable configured to measure at least one parameter related to the wellbore environment.

Certain terms are used throughout the description and claims to refer to particular features or components. As one skilled in the art will appreciate, different persons may refer to the same feature or component by different names. This document does not intend to distinguish between components or features that differ in name but not function.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A completion system for use in a wellbore, comprising:

an upper completion assembly comprising:

a stinger sub housing a first portion wet-mate connector; and and a lower completion assembly comprising:

a housing;

a shift sleeve moveable axially relative to the housing;

a wet-mate deployment carrier; and a second portion wet-mate connector connectable with the first portion wet-mate connector, wherein axial movement of the shift sleeve in a first direction moves the wet-mate deployment carrier and the second portion wet-mate connector from a radially outward position to a radially inward position such that the second portion wet-mate connector is positioned to connect with the first portion wet-mate connector.

2. The system of claim 1, wherein axial movement of the shift sleeve in a second direction opposite the first direction retracts the second portion wet-mate connector into the shift sleeve as the second portion wet-mate connector moves from the radially inward position to the radially outward position.

3. The system of claim 1, wherein:

the wet-mate deployment carrier comprises shift grooves angled with respect to an axial movement direction of the shift sleeve;

the shift sleeve comprises extensions movably constrained to travel within the shift grooves; and the axial movement of the shift sleeve moves the wet-mate deployment carrier radially due to the travel of the extensions within the shift grooves.

4. The system of claim 1, further comprising a control system operable to control the movement of the shift sleeve and thus the wet-mate deployment carrier.

5. The system of claim 1, wherein the first and second portion wet-mate connectors comprise fiber optic, electric, hydraulic, electro-hydraulic, or electro-fiber wet-mate connectors, or any combination thereof.

6. The system of claim 1, further comprising a second portion fiber optic cable connected with the second portion wet-mate connector, the second portion fiber optic cable configured to measure at least one parameter related to the wellbore environment.

7. The system of claim 1, further comprising a first portion fiber optic cable configured to transmit at least one of data or energy signals.

8. The system of claim 1, wherein the lower completion assembly further comprises one or more sand control screen assemblies.

9. A method for completing a wellbore comprising:

installing a lower completion assembly downhole in the wellbore, the lower completion assembly comprising a shift sleeve, a wet-mate deployment carrier, and a second portion wet-mate connector movable on the wet-mate deployment carrier;

conveying an upper completion assembly downhole into the wellbore, the upper completion assembly comprising a stinger sub housing a first portion wet-mate connector;

moving the shift sleeve axially relative to the wellbore in a first direction, thereby also moving the wet-mate deployment carrier and the second portion wet-mate connector from a radially outward position to a radially inward position; and connecting the first portion wet-mate connector with the second portion wet-mate connector in the radially inward position.

10. The method of claim 9, further comprising moving the shift sleeve axially in a second direction opposite the first direction, thereby retracting the second portion wet-mate connector into the shift sleeve in the radially outward position.

11. The method of claim 10, further comprising moving the shift sleeve axially using a mechanical force.

12. The method of claim 9, further comprising transmitting at least one of data or energy signals using a first portion fiber optic cable connected with the first portion wet-mate connector.

13. The method of claim 9, further comprising measuring at least one parameter related to the wellbore environment using a second portion fiber optic cable connected with the second portion wet-mate connector.

14. A completion system for use in a wellbore, comprising:

a lower completion assembly comprising:

a shift sleeve;

a wet-mate deployment carrier; and a wet-mate connector, wherein axial movement of the shift sleeve in a first direction moves the wet-mate deployment carrier and the wet-mate connector from a radially outward position to a radially inward position such that the wet-mate connector is positioned for wet-mate connection.

15. The system of claim 14, wherein axial movement of the shift sleeve in a second direction opposite the first direction retracts the wet-mate connector into the shift sleeve as the wet-mate connector moves from the radially inward position to the radially outward position.

16. The system of claim 14, wherein the wet-mate connector comprises a fiber optic, an electric, a hydraulic, an electro-hydraulic, or an electro-fiber wet-mate connector, or any combination thereof.

17. The system of claim 14, further comprising a fiber optic cable connected with the wet-mate connector, the fiber optic cable configured to measure at least one parameter related to the wellbore environment.

* * * * *